United States Patent [19]

Schron et al.

[11] Patent Number: 4,986,161

[45] Date of Patent: Jan. 22, 1991

[54] APPARATUS AND ASSOCIATED METHOD FOR REDUCING ELECTRICAL SWITCH ARCING

[75] Inventors: Dean Schron, Pittsburgh; George A. Kemeny, Wilkins Twp., Allegheny County; Dennis Pavlik, Murrysville; Francesco Stefani, Pittsburgh, all of Pa.

[73] Assignee: Westinghouse Electric Corp., Pittsburgh, Pa.

[21] Appl. No.: 284,565

[22] Filed: Dec. 15, 1988

[51] Int. Cl.[5] ..... F41B 6/00

[52] U.S. Cl. ..... 89/8; 124/3; 200/144 AP

[58] Field of Search ..... 89/8; 124/3; 200/144 AP

[56] References Cited

U.S. PATENT DOCUMENTS

| | | | |
|---|---|---|---|
| 851,467 | 4/1907 | Wood | 200/144 AP |
| 4,319,168 | 3/1982 | Kemeny | 318/135 |
| 4,423,662 | 1/1984 | McAllister | 89/8 |
| 4,433,607 | 2/1984 | Kemeny | 89/8 |
| 4,437,383 | 3/1984 | Deis et al. | 89/8 |
| 4,714,003 | 12/1987 | Kemeny | 89/8 |
| 4,841,833 | 6/1989 | Scherbarth et al. | 89/8 |

FOREIGN PATENT DOCUMENTS

| | | | |
|---|---|---|---|
| 748546 | 7/1980 | U.S.S.R. | 200/144 AP |

*Primary Examiner*—Stephen C. Bentley
*Attorney, Agent, or Firm*—D. Schron

[57] ABSTRACT

Electrical circuit inductively coupled to the circuit of an electromagnetic projectile launcher for beneficially reducing switch arcing duration and switch arc energy dissipation.

3 Claims, 3 Drawing Sheets

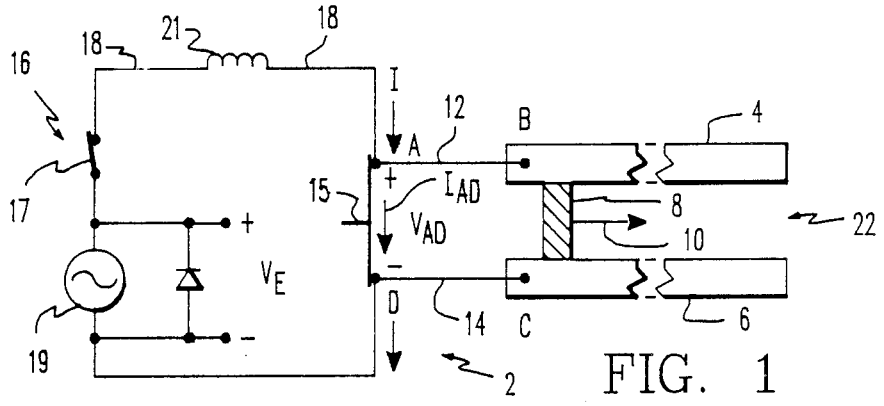
FIG. 1
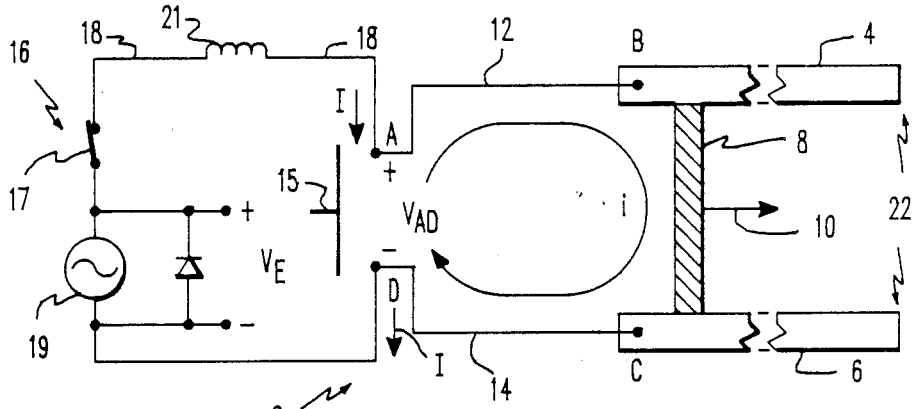
FIG. 2
FIG. 3
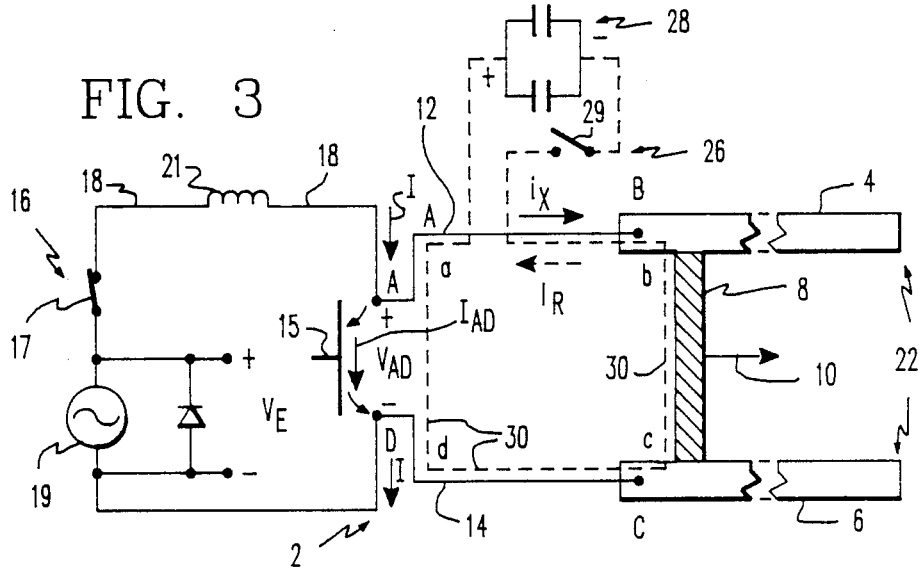

APPARATUS AND ASSOCIATED METHOD FOR REDUCING ELECTRICAL SWITCH ARCING

BACKGROUND OF THE INVENTION

1. Field of the Invention:

This invention relates to apparatus for significantly reducing and, preferably, eliminating electrical arcing across electrical switch contacts as the switch is opened and, preferably, for significantly reducing the electrical arcing across the launch switch of an electromagnetic projectile launcher.

2. Description of the Prior Art:

Electromagnetic projectile launchers, generally, include a pair of electrically conductive rails which guide a projectile. The projectile is launched by quickly injecting, or commutating, an electrical current, from a high current source, into one of the rails. The electrical current then passes through the armature of the projectile and returns to the current source through the other rail. Acceleration of the projectile is produced by the interaction of the current through the armature of the projectile and the magnetic field which is produced by the same current flowing in the conductive rails.

The current which accelerates the projectile is initially shunted through a closed electrical switch which is connected in parallel with the armature of the projectile so that the current bypasses the armature of the projectile. The switch is not opened until a sufficient magnitude of current has developed. The switch is then rapidly opened, thereby quickly removing the parallel shunt to launch the projectile. Such opening of the electrical switch causes an arc across the terminals of the switch due to the combination of the large magnitude of current flowing through the switch and the impedance of the rail/projectile armature circuit. Such electrical arcing is undesirable since the energy discharged in the arc generates heat which destroys the contacts of the switch.

SUMMARY OF THE INVENTION

Apparatus is provided for injecting electrical current into an electromagnetic projectile launcher which includes electrical injecting circuit apparatus for injecting an electrical current into the projectile launcher, launch apparatus operatively associated with the electrical circuit apparatus for launching the projectile and energy dissipation reduction apparatus for injecting electrical current in the launch apparatus and for reducing the amount of energy dissipated in the launch apparatus when the projectile is launched.

Also provided is apparatus for rapidly reducing the magnitude of current in a first portion of a first electrical circuit while simultaneously increasing the magnitude of current in a second portion of the first electrical circuit which includes a first electrical circuit with a first current flowing in a first direction through the first portion and a second electrical circuit operatively associated with the first electrical circuit for producing a second current in the first portion and the second portion of the first electrical circuit. The second current flows through the first portion in the opposite direction of the first direction, whereby the second current rapidly reduces the net magnitude of current flowing in the first portion and simultaneously increases the magnitude of current in the second portion.

Further provided is apparatus for inductively generating a current in a first electrical circuit for reducing the net magnitude of current in a first portion of the first electrical circuit and simultaneously increasing the magnitude of current in a second portion of the first electrical circuit which includes a first electrical circuit with a first current flowing in a first direction through the first portion and a second electrical circuit energized by charge capacitor apparatus and inductively coupled to the first electrical circuit for inducing a second current in the first portion and the second portion of the first electrical circuit. The second current flows through the first portion in the opposite direction of the first direction, whereby the second current reduces the magnitude of current flowing in the first portion and simultaneously increases the magnitude of current in the second portion.

Also provided is apparatus for rapid current commutation from a third electrical circuit to a second portion of a first electrical circuit which includes a third electrical circuit for developing a third current, a first electrical circuit electrically connected to the third electrical circuit for conducting the third current from the third electrical circuit to the second portion of the first electrical circuit, switching apparatus electrically connected to the third electrical circuit and the first electrical circuit which is capable of assuming a first state which limits the amount of third current received by the second portion of the first electrical circuit to below a predetermined level and capable of assuming a second state which allows rapid commutation of at least a portion of the third current from the third electrical circuit to the second portion of the first electrical circuit. Current controlling apparatus, which is operatively associated with the third electrical circuit and the first electrical circuit, is provided for simultaneously reducing the magnitude of current through the switching apparatus and increasing the magnitude of current through the second portion of the first electrical circuit prior to the switching apparatus assuming the second state.

Additionally provided is a method for reducing the magnitude of current in a first portion of a first electrical circuit while simultaneously increasing the magnitude of current in a second portion of the first electrical circuit which includes the steps of providing a first electrical circuit with a first current flowing in a first direction through the first portion, providing a second electrical circuit operatively associated with the first electrical circuit for producing a second current in the first portion and the second portion of the first electrical circuit, generating the current flowing in the first direction through the first portion and producing the second current in the first portion and the second portion of the first electrical circuit with the second current flowing in the first portion of the first electrical circuit in the opposite direction of the first direction, whereby the second current reduces the net magnitude of current flowing in the first portion of the first electrical circuit and simultaneously increases the magnitude of current in the second portion of the first electrical circuit.

Further provided is a method for inductively generating a current in a first electrical circuit for reducing the magnitude of current in a first portion of the first electrical circuit and simultaneously increasing the magnitude of current in a second portion of the first electrical circuit which includes the steps of providing a first electrical circuit with a first current flowing in a first direction through the first portion, providing a second electrical circuit energized by charge capacitor apparatus and inductively coupled to the first electrical circuit for inducing the second current in the first portion and the second portion of the first electrical circuit, generating the first current in the first direction through the first portion and inducing the second current in the first portion and the second portion of the first electrical circuit with the second current flowing in the first portion of the first electrical circuit in the opposite direction of the first direction, whereby the second current reduces the net magnitude of current flowing in the first portion and simultaneously increases the net magnitude of current in the second portion.

Also provided is a method for rapid current commutation from a third electrical circuit to a second portion of a first electrical circuit which includes the steps of providing a third electrical circuit for developing a third current, providing a first electrical circuit electrically connected to the third electrical circuit for receiving the third current from the third electrical circuit, providing switching apparatus electrically connected to the third electrical circuit and the first electrical circuit with the switching apparatus capable of assuming a first state which limits the amount of third current received by the second portion of the first electrical circuit to below a predetermined level and capable of assuming a second state which allows rapid commutation of at least a portion of the third current from the third electrical circuit to the second portion of the first electrical circuit, providing current controlling apparatus operatively associated with the third electrical circuit and the first electrical circuit for simultaneously reducing the magnitude of current through the switching apparatus and increasing the magnitude of current through the second portion of the first electrical circuit prior to the switching apparatus assuming the second state, developing the third current by the third electrical circuit, receiving the third current from the third electrical circuit, switching the switching apparatus to assume the first state to limit the amount of third current received by the second portion of the first electrical circuit to below a predetermined level, switching the switching apparatus to the second state to allow rapid commutation of at least a portion of the third current from the third electrical circuit to the second portion of the first electrical circuit and simultaneously reducing the magnitude of current through the switching apparatus and increasing the magnitude of current through the second portion of the first electrical circuit prior to the switching apparatus assuming the second state.

Additionally provided is a method for injecting electrical current into an electromagnetic projectile launcher which includes the steps of providing electrical injecting circuit apparatus for injecting the electrical current into the projectile launcher, providing launch apparatus operatively associated with the electrical injecting circuit apparatus for launching the projectile, providing energy dissipation reduction apparatus for reducing the amount of energy dissipated in the launch apparatus when the projectile is launched, injecting electrical current into the projectile launcher by the electrical injecting circuit apparatus, launching the projectile with the launch apparatus and reducing the amount of energy dissipated in the launch apparatus when the projectile is launched with the energy dissipation reduction apparatus.

Also provided is apparatus for injecting electrical current into an electromagnetic projectile launcher when the projectile is positioned at an intermediate location along the path of the projectile launcher which includes electrical injecting circuit apparatus electrically connected to the projectile launcher at an intermediate position along the launcher, switching apparatus operatively associated with the electrical circuit apparatus for injecting electrical current into the armature of the launcher and current reducing apparatus operatively associated with the electrical injecting circuit apparatus for rapidly reducing the magnitude of current through the switch apparatus when the switching apparatus injects the electrical current into the armature of the launcher.

Further provided is a method for injecting an electrical current into an electromagnetic projectile launcher when the projectile is positioned at an intermediate location along the path of the projectile launcher which includes the steps of providing electrical injecting circuit apparatus electrically connected to the projectile launcher at an intermediate position along the launcher, providing switch apparatus operatively associated with the electrical injecting circuit apparatus for injecting electrical current into the armature of the launcher, providing current reducing apparatus operatively associated with the electrical injecting circuit apparatus for rapidly reducing the magnitude of current through the switching apparatus when the switching apparatus injects the electrical current into the armature of the launcher, injecting electrical current into the armature of the launcher with the switching apparatus and reducing the magnitude of current through the switching apparatus when the switching apparatus injects electrical current into the armature of the launcher with the current reducing apparatus.

BRIEF DESCRIPTION OF THE DRAWINGS

The invention may be better understood and further advantages and uses thereof are readily apparent when considered in view of the following detailed description of the preferred embodiment taken with the accompanying drawings in which:

FIG. 1 is a schematic drawing of a prior art electromagnetic projectile launcher with the launch activation switch in the closed position;

FIG. 2 is a schematic drawing of the apparatus of FIG. 1 with the launch activation switch in the open position;

FIG. 3 is a schematic drawing of an electromagnetic projectile launcher which incorporates the present invention employed at the breech end of the launcher;

DETAILED DESCRIPTION OF THE PREFERRED EMBODIMENT

Figure 4:
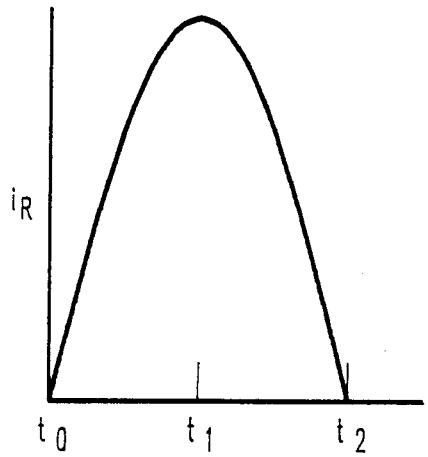
FIGS. 4 through 7 are graphs showing the relation between various circuit currents and time.

FIG. 1 shows prior art projectile launch system 2. Projectile launch system 2 includes launch rails 4 and 6, conducting armature 8, which is positioned at the breech or starting end of the launch system and which travels in the direction of arrow 10 when launched, conductors 12 and 14, launch activation switch 15 and current supply source 16. A projectile (not shown) is, typically, mechanically connected to armature 8. Armature 8 propels the projectile along launch rails 4 and 6 in the direction of arrow 10.

Current supply source 16 includes, typically, a homopolar generator 19 which can produce a current, I, of a magnitude in the order of 1.5 mega- amps at a voltage $V_E$ of, generally, about 1 kilovolt. Switches 15 and 17 are closed and current generator 19 is activated prior to the launching of armature 8 thereby causing current I to flow from current generator 19, through conductor 18, inductor 21, switch 15 and back to current generator 19. Loop ABCD comprises conductor 12, armature 8 and conductor 14.

Acceleration of armature 8 begins when switch 15 begins to open, as shown in FIG. 2. When switch 15 is opened, a portion of current I, i, becomes commutated into loop ABCD. The remainder of current I which does not initially travel through loop ABCD, I minus i, appears as arc current across the contacts of switch 15. After switch 15 has completed the current commutation, the arc is extinguished causing current, i, to equal current, I.

The flow of current through loop ABCD causes a strong magnetic field to develop to the left of armature 8 thereby imparting a magnetic force in the direction of arrow 10 on armature 8. That force propels armature 8, and the attached projectile along rails 4 and 6 and, ultimately, from muzzle 22 of projectile launch system 2.

When switches 17 and 15 are closed only negligible current flows through loop ABCD since switch 15 is of a low resistance resulting in $V_{AD}$ being very close to zero. A current of significant magnitude can be injected into loop ABCD only by a voltage, $V_{AD}$, of a sufficient magnitude to overcome the impedance of loop ABCD. The process of developing such a voltage and injecting a current into loop ABCD is called current injection or commutation. Such current injection may be more fully understood with reference to FIG. 2.

A time lapse exists between the moment when switch 15 initially begins to open and when switch 15 is fully opened and arcing across its contacts has ceased. Arc current, which equals I minus i, discharges through switch 15 during this time period, t. Loop ABCD has an inherent inductance $L_S$. It is well known that a voltage will be produced across an inductor any time a change in current occurs through the inductor, and that voltage will generate the arc voltage, $V_{AD}$ across switch 15 when it is initially opened, causing current, i, to be injected into loop ABCD, in a manner similar to a D.C. battery.

Current i substantially equals zero at the moment switch 15 begins to open. However, i equals I after time, t, has elapsed. The precise mathematical equations representing various properties of the circuit of projectile launch system 2 entail numerous, relatively complicated equations. However, such equations may be approximated with acceptable accuracy if it is assumed that $V_{AD}$ is constant and that current I does not change significantly over the time period, t. Additional simplification occurs if it is assumed that loop ABCD has no ohmic resistance. Such assumptions produce acceptable compromises in accuracy. The following equations represent approximations of the circuits of FIG. 2:

$$V_{AD} = L_S\, di/dt \quad (1)$$

$$\int V_{AD} dt = \int L_S\, di \quad (2)$$

$$E_S = \int (V_{AD})(i) dt = \int (L_S)(i) di, \quad (3)$$

where $E_S$ is the energy dissipated in the arc across switch 15 over time, t.

$$E_S = \tfrac{1}{2} L_S I^2 \quad (4)$$

where $\int_t i\, di = \frac{1}{2} I^2$ since i=I at the end of time, t.

It has been determined, experimentally, that reasonable values for the parameters in the above equations are as follows for a typical projectile launch system:

$V_{AD}$ = 1 kilovolt;
$I$ = 1.5 mega-amps; and
$L_s$ = 0.15 $\mu H$.

Using such experimental values, the commutation time period, t, will be approximately 225 microseconds and $E_s$ will be approximately 170 kilojoules. In actuality, $E_s$ will exceed 170 kilojoules since it is impossible to completely eliminate ohmic resistance in loop ABCD. Such actual resistance will increase both the commutation time period, t, and $E_s$.

The dissipation of 170 kilojoules in switch 15 during the launch of armature 8 reduces the total available launch energy by about 2%; an amount which may be considered negligible. However, the 170 kilojoules of energy is dissipated in the form of heat in switch 15. The dissipation of 170 kilojoules in the arc would result in contact material loss of an estimated 3 cubic centimeters per projectile launch assuming, conservatively, that only 10% of this energy would go into melting switch contact material. Such a large loss per launch is highly undesirable since it results in rapid switch failure. The circuit of FIG. 3, which employs the present invention, reduces the electrical arcing time and energy dissipation across the terminals of switch 15 thereby reducing the loss in contact material per projectile launch.

The circuit of FIG. 3 is similar to that of FIG. 1 with the exception that the circuit of FIG. 3 includes switch counter current circuit 26. Switch counter current circuit 26 includes capacitors 28, switch 29 and conductor 30. A portion of conductor 30 forms loop abcda. Loop abcda is a low ohmic resistance loop or, preferably, a pair of such loops in parallel, or series connection, one spaced closely above loop ABCDA and one below. Loop abcda is positioned to be closely magnetically coupled to loop ABCDA but is electrically insulated from loop ABCDA.

Figure 5:
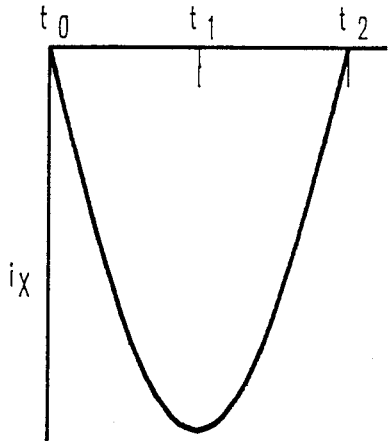

FIG. 4 shows the relation between $i_R$, the current through switch counter current circuit 26, as a function of time and under the assumption that no other switching occurs concurrently. Prior to time $t_0$, switch 29 is open and capacitors 28 are charged from an external source (not shown). At time $t_0$ switch 29 is closed causing current $i_R$ to increase and peak at time $t_1$ and then decreases until reaching zero at time $t_2$. Loop abcda will induce current $i_x$ in loop ABCDA with proper magnetic coupling between the two loops. The approximate relation between current $i_x$ and time is shown in FIG. 5.

Figure 6:
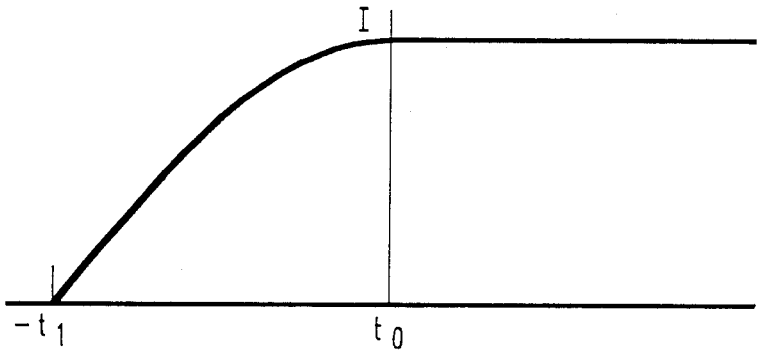

FIG. 6 shows the relation between current I, as generated by current supply source 16, with respect to time. When switch 17 closes at time $-t_1$, current I increases and then peaks and will stay at a relatively constant magnitude if current generator 19 is paralleled by a crowbar circuit as shown.

Figure 7:
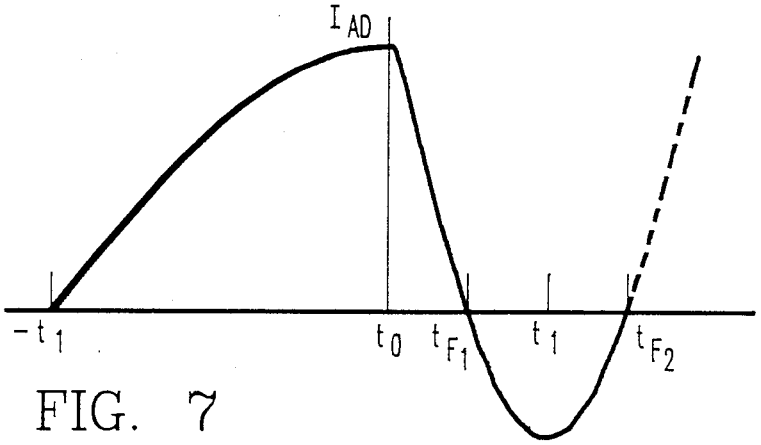

FIG. 7 shows the relationship between $I_{AD}$ and time. At about time $t_0$, current $I_{AD}$ has peaked and is at a relatively steady state value. At time $t_0$ switch 29 is closed thereby discharging capacitors 28 and generating current $i_R$ in conductor 30. Current $i_R$ generates a magnetic field in loop abcd which is closely inductively linked to loop ABCDA. The magnetic field change in loop ABCD induces current, $i_x$, which opposes current I in switch 15. Current $I_{AD}$ therefore drops in magnitude as a result of current $i_x$, since $I_{AD}$ equals I minus $i_x$, and reaches zero at time $t_{F1}$.

By properly sizing capacitors 28 and the magnetic flux linkage between loop abcda and loop ABCDA, the peak magnitude of current, $i_x$, will somewhat exceed the magnitude of current I causing a momentary period, between $t_{F1}$ and $t_{F2}$, when current $I_{AD}$ is flowing in the opposite direction of current I. As capacitors 28 recharge, current $I_{AD}$ again reaches zero at time $t_{F2}$ and $I_{AD}$ would increase as shown by the dashed line if there were no current interruption at the second current zero.

Ideally, it would be desirable to open switch 15 at precisely $t_{F1}$ or $t_{F2}$, that is, at a current zero. If this were possible then there would be no arcing during switch contact separation and no contact deterioration. Such performance is, however, not attainable with a mechanical switch 15. Such a switch will have massive contacts which cannot be accelerated sufficiently so that a sufficient separation distance will result after the current zero to prevent recommencement of arcing. Such a recommencement of arcing would be brought on by the rapidly occurring voltage rise across the switch contacts after the current zero and current interruption.

From a practical standpoint, switch 15 can be opened at about $t_o$ rather than $t_{F1}$ or $t_{F2}$, when $I_{AD}$ is non-zero, thereby causing arcing to briefly occur across the terminals of switch 15. The amount of energy dissipated in such an arc, however, will be relatively small since the magnitude of current flowing through the arc will be very rapidly decreasing. The following calculations represent typical numerical values under practical circuit conditions.

Loop ABCD has typical inductance, $L_s$, of about 0.15 μH. Additionally, current supply source 16 provides a current, I, of approximately 1.5 mega-amps. The net capacitance of capacitors 28 can reasonably be chosen to be about 900 μF at a charge of about 10 kV. Under those parameters $i_R$ will peak at about 1.78 mega-amps in about 8 microseconds after switch 29 is closed.

Current $i_x$ will peak at about 1.6 mega-amps if the coupling between loops ABCDA and abcda is 0.9, which is typical. Current $I_{AD}$ will, therefore, flow in the opposite direction from current I, momentarily, since I is less than the maximum value of current $i_x$.

Under the above conditions, $E_S$ would be equal to 10 kilojoules, based on the initially assumed constant switch 15 voltage $V_{AD}$ of one kilovolt. However, by employing circuit 26, the magnitude of arc voltage $V_{AD}$ is of secondary importance and may be significantly lowered without extending the commutation duration. If the arc voltage is reduced by, for example, a factor of four, then $E_s$ would also be reduced to only about 2.5 kilojoules.

The above described practical example was based on the closing of switch 29 at about the time $t_0$ thereby allowing a short period of arcing between $t_0$ and $t_{F1}$. Such a sequencing of switching events could be achieved by allowing the appearance of arc voltage across switch 15 immediately or after a short time delay, to trigger the closure of switch 29.

Another approach is to direct current I temporarily, and very briefly, into an array of switching devices (not shown), such as ignitrons, and then close switch 29 just before current I is to be directed into loop ABCD. Switch 15 would then be opened at precisely the desired time by thyristors, SCR's or ignitrons at $t_{F1}$ and those devices would remain non-conducting until reset for the next projectile launch. Such circuit arrangements are well known to those skilled in the art.

It should be understood that for this procedure, a mechanical contact switch, or an array of switches, would perform the function of switch 15 during the relatively long time interval from $-t_1$ to $t_o$, which can be a few hundred miliseconds. The array of ignitrons, SCR's or thyristors would then perform the function of switch 15 from about $t_o$ to $t_{F1}$ which may be of a duration of a few tens of microseconds.

Figure 8:
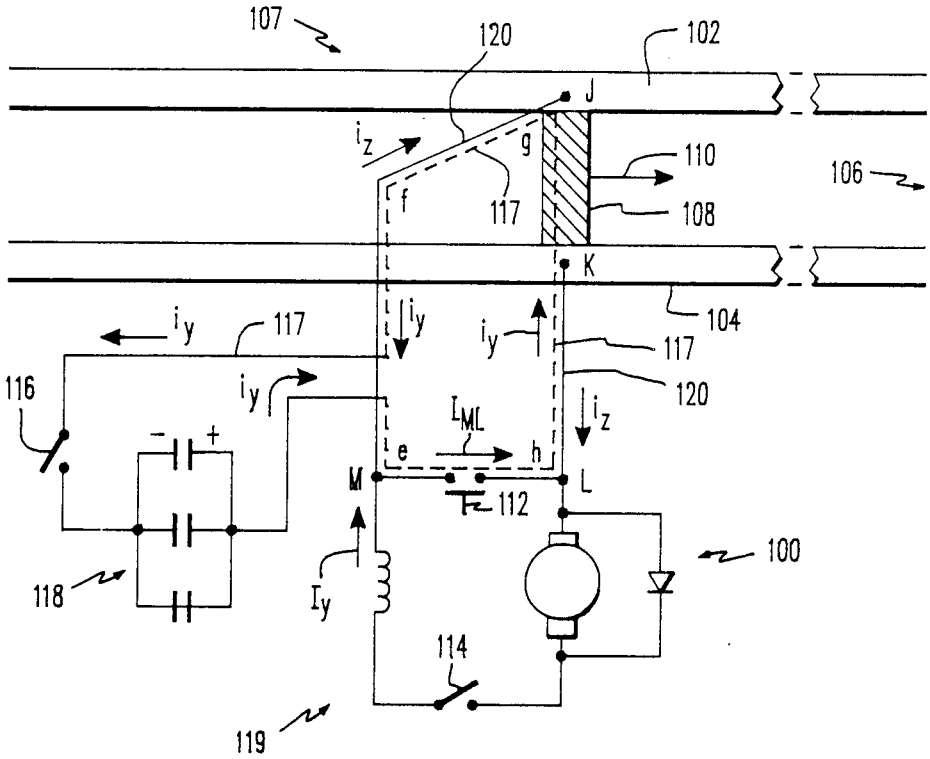
FIG. 8 is a schematic drawing of the present invention employed at a position along the launcher which is intermediate the breech end and the muzzle.

FIG. 8 shows current injecting apparatus 119. In FIG. 8, current supply source 100 is connected to rails 102 and 104 of electromagnetic projectile launcher 107 at points J and K. Points J and K are located at positions which are intermediate from the breech of the launcher (points B and C of FIG. 3) and muzzle 106. A plurality of current supply sources 100 may be positioned at a plurality of intermediate locations along rails 102 and 104, although only one is shown in FIG. 8 for clarity. A more even and efficient injection of power to armature 108 occurs when a plurality of current supply sources 100 are provided along rails 102 and 104, as shown in FIG. 8. That is because projectile rail ohmic losses will be lowered since current is not conducted all the way from the breech.

The circuit of FIG. 8 functions in the following manner. Armature 108 is assumed to be travelling along rails 102 and 104 in the direction of arrow 110. Such initial velocity may be accomplished by employing the apparatus of FIG. 3. When armature 108 reaches the vicinity of points J and K, additional energy is injected by the opening of switch 112 of current supply source 100. Switch 112 is opened after switch 114 has been closed for a period of time sufficient to develop the necessary firing current, $i_y$ which propels armature 108 in the direction of arrow 100.

At about the moment that switch 112 is opened, switch 116 is closed thereby discharging capacitors 118 which causes $i_y$ to flow in conductor 117. Loop ehgfe is magnetically coupled to conductor 120 thereby inducing current $i_z$ in loop JKLMJ. If the coupling between loop ehgfe and loop JKLMJ is of sufficient magnitude, current $i_{ML}$ flowing through switch 112 will be counteracted by current $i_z$ and two successive current zeros will result. The current zeros occur very shortly after the opening of switch 112 resulting in minimal electrical arcing across the terminals of switch 112. The circuit of FIG. 8 is the same as the circuit of FIG. 3 with the exception that the output, at points J and K, of current supply source 100 are located along rails 102 and 104 at a position which is intermediate the breech of the projectile and muzzle 106.

Although a metallic armature has been illustrated which provides the required current conduction across the rails and which accelerates a projectile attached to it, it should be understood that a plasma or arc armature can similarly provide the current path between the rails of the projectile launcher. As is well known, a plasma or arc armature is a volume of conducting gas formed across rails 4 and 6 when no metalic current path is provided. In this case, the plasma or arc armature may apply the accelerating force in the form of gas pressure against a bore-sealing and electrically insulating sabot which fixtures and accelerates the projectile.

It may be appreciated, therefore, that the present invention allows rapid current injection from a current source to an electromagnetic projectile launcher while, at the same time, reduces energy dissipation in the launch switch far below typically encountered values. The present invention, thus, significantly reduces damage to such switches caused by switch arcing.

Whereas particular embodiments of the invention have been described above for purposes of illustration, it will be evident to those skilled in the art that numerous variations of the details may be made without departing from the invention as defined in the appended claims.

What is claimed is:

1. Apparatus for rapidly reducing the magnitude of current in a first portion of a first electrical circuit while simultaneously increasing the magnitude of current in a second portion of the first electrical circuit comprising:

first electrical circuit with a first current flowing in a first direction through said first portion; and second electrical circuit operatively associated with said first electrical circuit for producing a second current in said first portion and said second portion of said first electrical circuit;

said second current flowing through said first portion in the opposite direction of said first direction;

said second electrical circuit induces said second current in said first electrical circuit;

said second electrical circuit includes means for reducing the net magnitude of current in said first portion to substantially zero; and said second electrical circuit includes capacitor means for producing said second current, whereby said second current rapidly reduces the net magnitude of current flowing in said first portion and simultaneously increases the magnitude of current in said second portion.

2. Apparatus for inductively generating a current in a first electrical circuit and for reducing the net magnitude of current in a first portion and a switch means of the first electrical circuit and simultaneously increasing the magnitude of current in a second portion of the first electrical circuit comprising:

first electrical circuit with a first current flowing in a first direction through said first portion, said first electrical circuit having switch means for controlling said first current; and second electrical circuit energized by charged capacitor means and inductively coupled to said first electrical circuit for inducing a second current in said first portion and said second portion of said first electrical circuit;

said second current flowing through said first portion and said switch means in the opposite direction of said first direction, whereby said second current reduces the net magnitude of current flowing in said first portion and said switch means and simultaneously increases the magnitude of current in said second portion.

3. A method for inductively generating a current in a first electrical circuit for rapidly reducing the net magnitude of current in a first portion and a switch means of the first electrical circuit and simultaneously increasing the magnitude of current in a second portion of the first electrical circuit comprising the steps of:

providing a first electrical circuit with a first current flowing in a first direction through said first portion, said first electrical circuit having switch means for controlling said first current;

providing a second electrical circuit energized by charged capacitor means and inductively coupled to said first electrical circuit for inducing a second current in said first portion and said second portion of said first electrical circuit;

generating said first current in said first direction through said first portion; and inducing said second current in said first portion and said second portion of said first electrical circuit, said second current flowing in said first portion of said first electrical circuit and said switch means in the opposite direction of said first direction, whereby said second current reduces the net magnitude of current flowing in said first portion and said switch means and simultaneously increases the net magnitude of current in said second portion.

* * * * *